US011454905B2

(12) United States Patent
Kainuma

(10) Patent No.: US 11,454,905 B2
(45) Date of Patent: Sep. 27, 2022

(54) IMAGE FORMING APPARATUS

(71) Applicant: KYOCERA Document Solutions Inc., Osaka (JP)

(72) Inventor: Takashi Kainuma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/375,216

(22) Filed: Jul. 14, 2021

(65) Prior Publication Data

US 2022/0019160 A1 Jan. 20, 2022

(30) Foreign Application Priority Data

Jul. 16, 2020 (JP) ..... JP2020-121821

(51) Int. Cl.
*G03G 15/20* (2006.01)
*G03G 15/16* (2006.01)

(52) U.S. Cl.
CPC ..... *G03G 15/1615* (2013.01)

(58) Field of Classification Search
CPC ..... G03G 15/00; G03G 15/1615; G03G 15/20
USPC ..... 399/159, 162, 165, 308
See application file for complete search history.

(56) References Cited

U.S. PATENT DOCUMENTS

2008/0056778 A1* 3/2008 Tao et al. ..... G03G 15/20
2014/0008184 A1 1/2014 Hozumi et al. ..... 198/806

FOREIGN PATENT DOCUMENTS

EP 3081992 * 10/2016
JP 2014-10429 A 1/2014

* cited by examiner

*Primary Examiner* — Hoan H Tran
(74) *Attorney, Agent, or Firm* — Stein IP, LLC

(57) ABSTRACT

An image forming apparatus includes a plurality of image carrying members, an intermediate transfer belt, a plurality of rollers, and a correcting mechanism. The intermediate transfer belt is endless and, to it, toner images formed on the image carrying members respectively are transferred by being sequentially superposed on each other. The correction mechanism includes a slanted bearing, which rotatably supports a tension roller, and a main body guide roller, which makes contact with the slanted bearing when it moves as a result of the intermediate transfer belt meandering and which moves the slanted bearing along with one end of the tension roller in the axial direction in the direction perpendicular to the axial direction to correct meandering of the intermediate transfer belt with respect to the tension roller. The main body guide roller is a rotary member which rotates while in contact with the slanted bearing.

3 Claims, 3 Drawing Sheets

IMAGE FORMING APPARATUS

INCORPORATION BY REFERENCE

This application is based upon and claims the benefit of priority from the corresponding Japanese Patent Application No. 2020-121821 filed on Jul. 16, 2020, the entire contents of which are hereby incorporated by reference.

BACKGROUND

The present disclosure relates to an image forming apparatus.

As image forming apparatuses of an electrophotographic type such as copiers and printers, there are known image forming apparatuses that employ an intermediate transfer system in which toner images of different colors formed on the outer circumferential faces of a plurality of photosensitive drums respectively are primarily transferred, while being sequentially superposed on each other, to an endless intermediate transfer belt arranged along the plurality of photosensitive drums (image carrying members), and then the toner images are secondarily transferred to a sheet. Inconveniently, in these conventional image forming apparatuses, the intermediate transfer belt can deviate in the axial direction of the roller which rotatably supports the intermediate transfer belt, that is, the intermediate transfer belt can meander.

To cope with this problem, there has been proposed a technique to correct the meandering of the intermediate transfer belt through adjustment of the alignment of a roller. A conventional technique has been proposed which can correct the meandering of the intermediate transfer belt by adjusting the alignment of a roller.

For example, a known image forming apparatus includes an axis displacement portion and an axis guide portion. The axis displacement portion is movable in the axial direction of a roller as the belt moves in the axial direction, and has a slanted face that is inclined with respect to the belt face. The axis guide portion is fixed so as to face the slanted face of the axis displacement portion. In this image forming apparatus, when the belt moves (meanders) in the axial direction of the roller, the contact position at which the axis displacement portion in the axis guide portion makes contact with the slanted face of the axis displacement portion deviates upward and the axis displacement portion moves downward, with the result that the roller inclines. As the roller inclines, the belt inclines steeply to move in the direction returning to its original position with respect to the axial direction of the roller. In this way it is possible to correct the meandering of the belt.

SUMMARY

According to one aspect of the present disclosure, an image forming apparatus includes a plurality of image carrying members, an intermediate transfer belt, a plurality of rollers, and a correcting mechanism. The intermediate transfer belt is endless and, to it, toner images formed on the image carrying members respectively are transferred by being sequentially superposed on each other. The plurality of rollers rotatably support the intermediate transfer belt. The correcting mechanism corrects the meandering of the intermediate transfer belt with respect to the roller. The correcting mechanism includes a slanted bearing and a main body guide. The slanted bearing has a slanted portion that is slanted with respect to the axial direction of the roller. The slanted bearing rotatably supports the shaft portion of one roller among the plurality of rollers and is movable in the axial direction of the roller. The main body guide makes contact with the slanted portion of the slanted bearing when the slanted bearing, as a result of the intermediate transfer belt meandering, moves in the axial direction of the roller, and then moves the slanted bearing along with one end of the roller in the axial direction in the direction perpendicular to the axial direction. The main body guide is a rotary member which rotates, while in contact with the slanted bearing, about an axis extending in the direction perpendicular to the axial direction of the roller.

DETAILED DESCRIPTION

An embodiment of the present disclosure will be described below with reference to the accompanying drawings. The present disclosure is, however, not limited to what is specifically described below.

Figure 1:
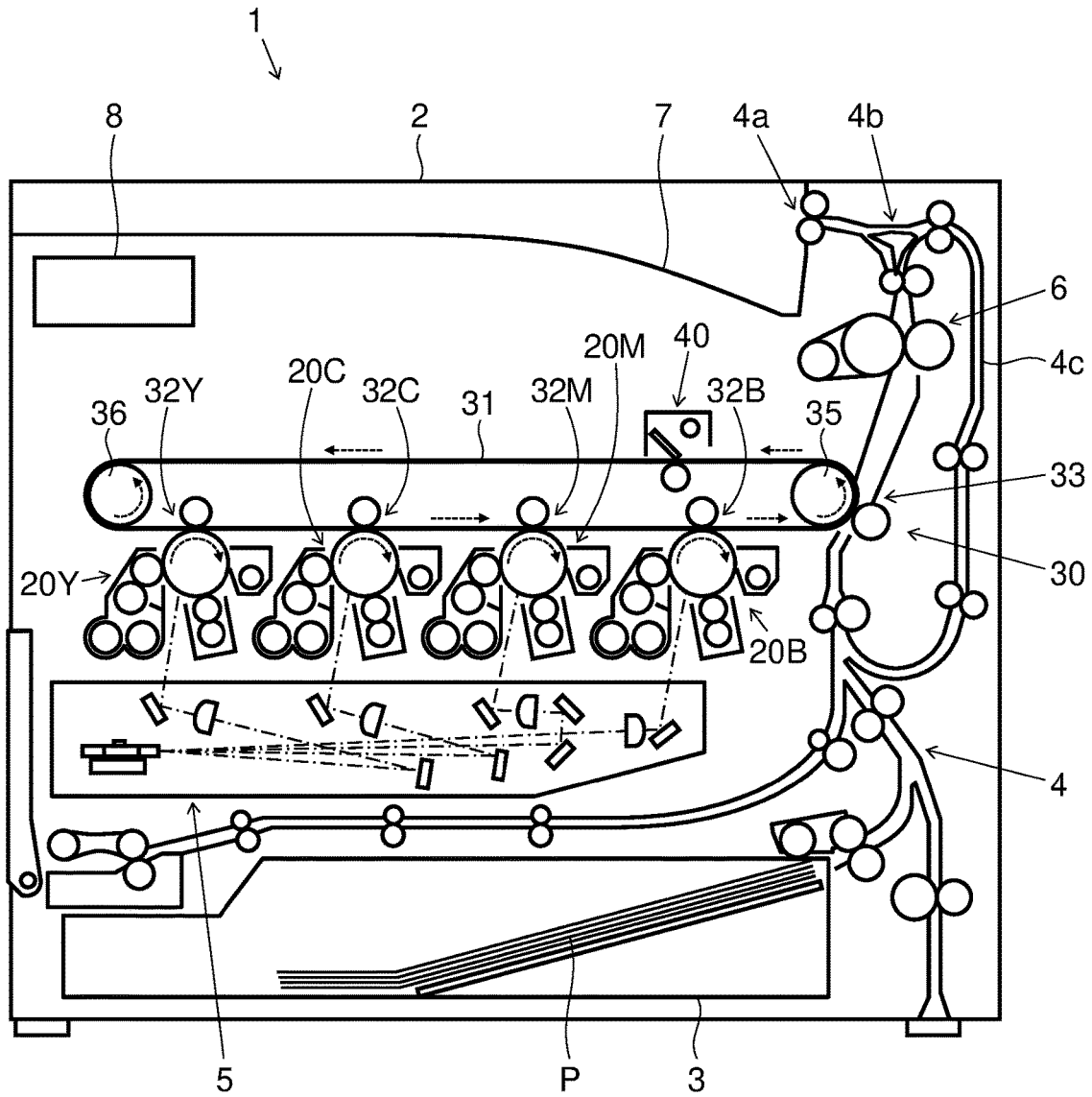
FIG. 1 is a schematic sectional view showing a structure of an image forming apparatus according to an embodiment of the present disclosure.
Figure 2:
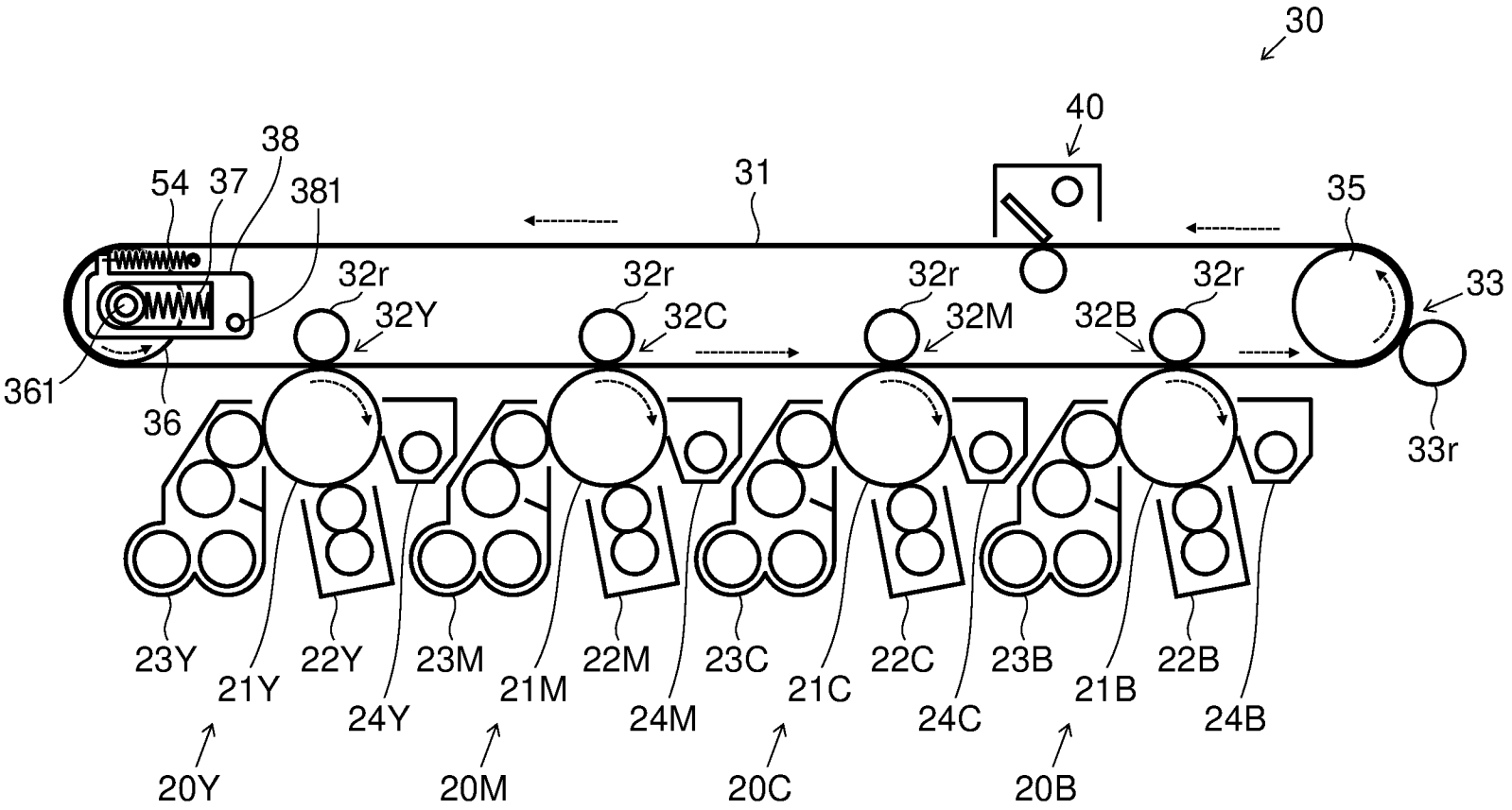
FIG. 2 is a schematic partial sectional view of and around an intermediate transfer belt in the image forming apparatus in FIG. 1.

FIG. 1 is a schematic sectional view showing the structure of an image forming apparatus 1 according to the embodiment. FIG. 2 is a schematic partial sectional view of and around an intermediate transfer belt 31 in the image forming apparatus 1 shown in FIG. 1. One example of the image forming apparatus 1 according to the embodiment is a color printer of a tandem-type which transfers a toner image onto a sheet S using the intermediate transfer belt 31. The image forming apparatus 1 may be what is called a multifunction peripheral provided with the functions of, for example, printing, scanning (image reading), and facsimile transmission.

As shown in FIGS. 1 and 2, the image forming apparatus 1 includes, in its main body 2, a sheet feeding portion 3, a sheet conveying portion 4, an exposure portion 5, an image forming portion 20, a transfer portion 30, a fixing portion 6, a sheet discharge portion 7, and a control portion 8.

The sheet feeding portion 3 stores a plurality of sheets S and, during printing, feeds them out one after another separately. The sheet conveying portion 4 conveys a sheet S fed out from the sheet feeding portion 3 to a secondary transfer portion 33 and then to the fixing portion 6, and then discharges the sheet S after fixing through a sheet discharge port 4*a* to the sheet discharge portion 7. When two-side printing is performed, the sheet conveying portion 4 switches, with a branch portion 4*b*, the conveying direction of the sheet S after fixing on its first side to an inverting conveying portion 4*c*, and conveys the sheet S to the secondary transfer portion 33 and then to the fixing portion 6 once again. The exposure portion 5 shines, toward the image forming portion 20, laser light that is controlled based on image data.

The image forming portion 20 is arranged under the intermediate transfer belt 31. The image forming portion 20 includes an image forming portion for yellow 20Y, an image forming portion for cyan 20C, an image forming portion for magenta 20M, and an image forming portion for black 20B. These four image forming portions 20 have basically similar structures. Thus, in the following description, the letters "Y", "C", "M", and "B" distinguishing different colors may be omitted unless distinction is needed.

The image forming portion 20 includes a photosensitive drum (image carrying member) 21 which is supported so as to be rotatable in a predetermined direction (the clockwise direction in FIGS. 1 and 2). The image forming portion 20 further includes, arranged around the photosensitive drum 21 along its rotation direction, a charging portion 22, a developing portion 23, and a drum cleaning portion 24. A primary transfer portion 32 is arranged between the developing portion 23 and the drum cleaning portion 24.

The photosensitive drum 21 has a photosensitive layer around its outer circumferential face. The charging portion 22 electrically charges the outer circumferential face of the photosensitive drum 21 to a predetermined potential. The exposure portion 5 exposes to light the outer circumferential face of the photosensitive drum 21 charged by the charging portion 22 to form on it an electrostatic latent image of the document image. The developing portion 23 develops the electrostatic latent image by feeding toner to it to form a toner image. The four image forming portions 20 form toner images of different colors respectively.

The transfer portion 30 includes an intermediate transfer belt 31, primary transfer portions 32Y, 32C, 32M, and 32B, a secondary transfer portion 33, and a belt cleaning portion 40. The intermediate transfer belt 31 is arranged above the four image forming portions 20. The intermediate transfer belt 31 is an endless intermediate transfer member which is supported so as to be rotatable in a predetermined direction (counter-clockwise in FIGS. 1 and 2) and to which the toner images formed on the four image forming portions 20 are sequentially superposed on each other and thereby primarily transferred. The four image forming portions 20 are arranged in what is called a tandem formation in which they are arranged in a row from upstream to downstream in the rotation direction of the intermediate transfer belt 31.

The primary transfer portions 32Y, 32C, 32M, and 32B are arranged across the intermediate transfer belt 31 over the image forming portions for different colors 20Y, 20C, 20M, and 20B. The secondary transfer portion 33 is arranged upstream of the fixing portion 6 in the sheet conveying direction in the sheet conveying portion 4 and downstream of the image forming portions for different colors 20Y, 20C, 20M, and 20B in the rotation direction of the intermediate transfer belt 31 in the transfer portion 30. The belt cleaning portion 40 is arranged upstream of the image forming portions for different colors 20Y, 20C, 20M, and 20B in the rotation direction of the intermediate transfer belt 31.

A toner image is primarily transferred to the outer circumferential face of the intermediate transfer belt 31 in the primary transfer portions for different colors 32Y, 32C, 32M, and 32B. Then, as the intermediate transfer belt 31 rotates, the toner images on the four image forming portions 20 are sequentially superposed on each other and thereby transferred to the intermediate transfer belt 31 with predetermined timing. In this way, a color toner image with the toner images of four colors, namely yellow, cyan, magenta, and black, superposed together is formed on the outer circumferential face of the intermediate transfer belt 31. The drum cleaning portion 24, after primary transfer, performs cleaning by removing deposits such as toner left on the outer circumferential face of the photosensitive drum 21.

The color toner image on the outer circumferential face of the intermediate transfer belt 31 is transferred to a sheet S conveyed in synchronism by the sheet conveying portion 4 at the secondary transfer nips formed in the secondary transfer portion 33. The belt cleaning portion 40, after secondary transfer, performs cleaning by removing deposits such as toner left on the outer circumferential face of the intermediate transfer belt 31.

The fixing portion 6 heats and presses the sheet S to which the toner image has been transferred to fix the toner image on the sheet S.

The control portion 8 includes a CPU, an image processing portion, a storage portion, and other electronic circuits and components (none of these are illustrated). The CPU, based on control programs and data stored in the storage portion, controls the operation of different components provided in the image forming apparatus 1 to perform processing related to the functions of the image forming apparatus 1. The sheet feeding portion 3, the sheet conveying portion 4, the exposure portion 5, the image forming portion 20, the transfer portion 30, and the fixing portion 6 individually receive commands from the control portion 8 and coordinate to perform printing on the sheet S. The storage portion is composed of a combination of, for example, a non-volatile storage device such as a program ROM (read-only memory) and a data ROM and a volatile storage device such as a RAM (random-access memory).

Next, the construction of and around the transfer portion 30 will be described with reference to FIG. 2.

The intermediate transfer belt 31 is, as shown in FIG. 2, arranged along the four image forming portions 20. Over the four image forming portions 20, primary transfer rollers 32*r* are respectively arranged across the intermediate transfer belt 31. The four primary transfer rollers 32*r* are each arranged at a position opposite the photosensitive drum 21 across the intermediate transfer belt 31 and is in contact with the inner circumferential face of the intermediate transfer belt 31.

The intermediate transfer belt 31 is rotatably stretched around a plurality of rollers. In the embodiment, the plurality of rollers each include a driving roller 35 and a tension roller 36.

The driving roller 35 is arranged downstream of the four image forming portions 20Y, 20C, 20M, and 20B in the rotation direction of the intermediate transfer belt 31. The driving roller 35 receives a driving force from a drive motor (unillustrated) to rotate the intermediate transfer belt 31 counter-clockwise in FIG. 2.

The driving roller 35 is arranged adjacent to the secondary transfer portion 33. In the secondary transfer portion 33, a secondary transfer roller 33*r* is arranged. The secondary transfer roller 33*r* is arranged at a position opposite the driving roller 35 across the intermediate transfer belt 31 and is in contact with the outer circumferential face of the intermediate transfer belt 31.

The tension roller 36 is arranged upstream of the four image forming portions 20Y, 20C, 20M, and 20B in the rotation direction of the intermediate transfer belt 31. As the intermediate transfer belt 31 rotates, the tension roller 36 rotates counter-clockwise in FIG. 2. The tension roller 36 is urged by a tension spring 37 in a direction moving away from the driving roller 35. This gives a predetermined tension to the intermediate transfer belt 31.

The tension spring 37 is held inside a tension guide member 38. The tension spring 37 is, for example, a compression coil spring and is arranged between the tension guide member 38 and a shaft portion 361 of the tension roller 36. The tension spring 37 urges the tension roller 36 in a direction moving away from the driving roller 35.

The tension guide member 38 is arranged at each end of the tension roller 36 in its axial direction (the depth direction with respect to the plane of FIG. 2). The tension guide member 38 has a shaft portion 381 which is arranged in a direction approaching the driving roller 35 with respect to the tension roller 36 and which extends parallel to the axial direction of the tension roller 36, and is supported on the main body 2 so as to be pivotable about the axis of the shaft portion 381.

The tension guide member 38 is formed of, for example, sheet metal and extends in the direction perpendicular to the axial direction of the tension roller 36, in the up-down direction. The tension guide member 38 supports the shaft portion 361 of the tension roller 36 such that the shaft portion 361 is movable in directions moving closer to and away from the driving roller 35. The tension guide member 38 is urged by an urging member 54, described later, arranged above the tension guide member 38 in the direction to rotate clockwise in FIG. 2 about the axis of the shaft portion 381.

Figure 3:
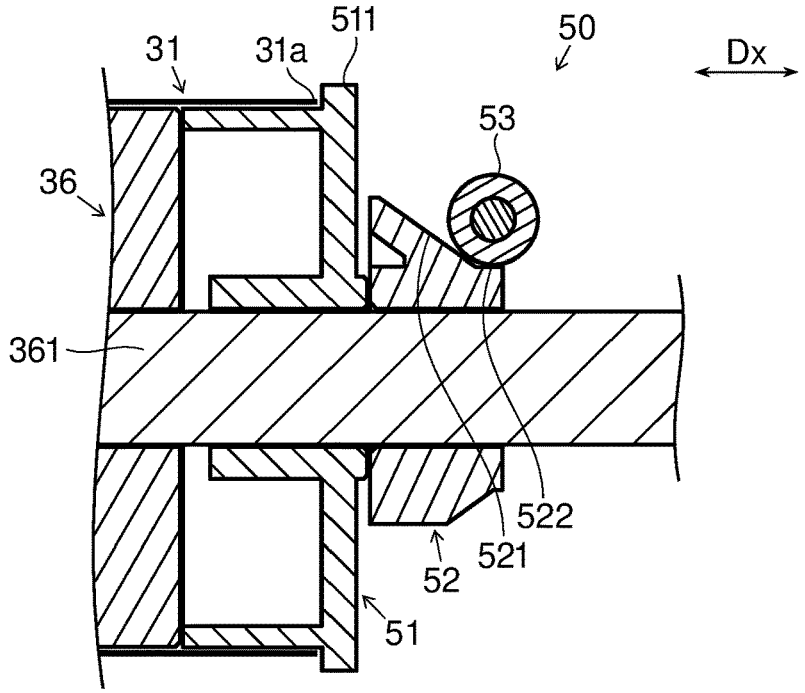
FIG. 3 is a partial sectional view of and around a tension roller for the intermediate transfer belt in FIG. 2.
Figure 4:
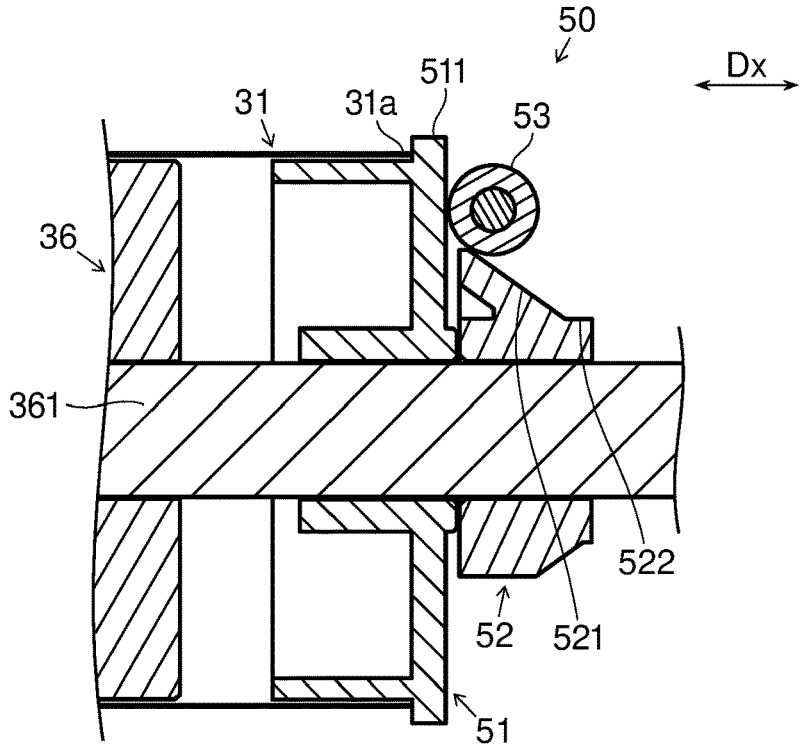
FIG. 4 is a partial sectional view of and around the tension roller in FIG. 3, illustrating a state where the intermediate transfer belt is meandering.

Next, the construction of and around the tension roller 36 for the intermediate transfer belt 31 will be described with reference to FIGS. 3 and 4. FIG. 3 is a partial sectional view of and around the tension roller 36 for the intermediate transfer belt 31 in FIG. 2. FIG. 4 is a partial sectional view of and around the tension roller 36 in FIG. 3, illustrating a state where the intermediate transfer belt 31 is meandering.

The image forming apparatus 1 includes a correcting mechanism 50 shown in FIGS. 3 and 4. The correcting mechanism 50 is arranged in a part of the shaft portion 361 of the tension roller 36 at each end of the tension roller 36 in its axial direction Dx. FIGS. 3 and 4 are diagrams of the correcting mechanism 50 arranged at one end of the tension roller 36 in its axial direction Dx as seen from the direction perpendicular to the axial direction Dx of the tension roller 36. In FIGS. 3 and 4, leftward in the diagram is inward of the tension roller 36 in its axial direction Dx, and rightward in the diagram is outward of the tension roller 36 in its axial direction Dx.

The correcting mechanism 50 corrects the meandering of the intermediate transfer belt 31 with respect to the tension roller 36. The correcting mechanism 50 includes a belt guide 51, a slanted bearing 52, a main body guide roller (main body guide, rotary member) 53, and an urging member 54 (see FIG. 2).

The belt guide 51 is arranged at each end of the tension roller 36 in its axial direction Dx. The belt guide 51 is arranged inward of the slanted bearing 52 in the axial direction Dx of the tension roller 36. The belt guide 51 is a ring-form member which extends in the radial direction about the axis of the tension roller 36, and the shaft portion 361 of the tension roller 36 penetrates, in the axial direction Dx, the belt guide 51 in a central part of it in the radial direction. The belt guide 51 is movable in the axial direction Dx of the tension roller 36. The belt guide 51 has a guide wall 511.

The guide wall 511 is arranged in an outer edge part of the belt guide 51 in the radial direction, and projects outward in the radial direction and then extends in the circumferential direction in a ring-form. The guide wall 511 faces and makes contact with a side edge 31*a* of the intermediate transfer belt 31 in the axial direction Dx of the tension roller 36.

The slanted bearing 52 is arranged outward of the belt guide 51 in the axial direction Dx of the tension roller 36. The slanted bearing 52 supports the shaft portion 361 of the tension roller 36 such that the shaft portion 361 is pivotable about the axis. The slanted bearing 52 is movable in the axial direction Dx of the tension roller 36. The slanted bearing 52 has a slanted portion 521 and a parallel portion 522.

The slanted portion 521 is formed inward of the parallel portion 522 in the axial direction Dx of the tension roller 36 so as to be continuous with the parallel portion 522. The slanted portion 521 is located above the shaft portion 361 of the tension roller 36 and faces the main body guide roller 53 along the up-down direction.

The outer face of the slanted portion 521 is slanted with respect to the axial direction Dx of the tension roller 36. More specifically, the slanted portion 521 is so slanted as to be, while extending from outward to inward (from right to left in FIGS. 3 and 4) in the axial direction Dx of the tension roller 36, increasing outward (upward in FIGS. 3 and 4) from a central part of the tension roller 36 in the radial direction.

The parallel portion 522 is formed outward of the slanted portion 521 in the axial direction Dx of the tension roller 36 so as to be continuous with the slanted portion 521. The outer face of the parallel portion 522 extends parallel to the axial direction Dx of the tension roller 36.

The main body guide roller 53 is a rotary member that rotates about an axis extending in the direction (the depth direction with respect to the plane of FIGS. 3 and 4) perpendicular to the axial direction Dx of the tension roller 36. The main body guide roller 53 is arranged above the slanted bearing 52 and is rotatably supported on the main body 2 of the image forming apparatus 1. The main body guide roller 53 faces the slanted bearing 52 along the up-down direction and rotates while in contact with the slanted bearing 52.

An urging member 54 (see FIG. 2) is arranged above the tension guide member 38. The urging member 54 is, for example, a tension coil spring and is arranged between the main body 2 and the tension guide member 38.

The urging member 54 urges the tension guide member 38 in the direction to rotate clockwise in FIG. 2 about the axis of the shaft portion 381. That is, the urging member 54, via the tension guide member 38, urges the shaft portion 361 of the tension roller 36 upward. In other words, the urging member 54 urges the slanted bearing 52 toward the main body guide roller 53 so as to keep the slanted bearing 52 in contact with the main body guide roller 53.

When, as shown in FIG. 3, the intermediate transfer belt 31 rotates normally without meandering, the shaft portion 361 of the tension roller 36 is urged upward by the urging member 54, and thereby the slanted bearing 52 is pressed against the main body guide roller 53. The main body guide roller 53 makes contact with the parallel portion 522 of the slanted bearing 52. When the intermediate transfer belt 31 rotates normally, the state in FIG. 3 is maintained.

When, as shown in FIG. 4, the intermediate transfer belt 31 is meandering, the intermediate transfer belt 31 makes contact with the guide wall 511 of the belt guide 51 to press the belt guide 51 outward (rightward in FIG. 4) in the axial direction Dx. The belt guide 51 moves outward in the axial direction Dx. Then, the belt guide 51 presses the slanted bearing 52 outward in the axial direction Dx. The slanted bearing 52 moves outward in the axial direction Dx.

Thus, the main body guide roller 53 that is in contact with the parallel portion 522 of the slanted bearing 52 rolls on the outer face of the slanted bearing 52 to make contact with the slanted portion 521 of the slanted bearing 52. That is, the main body guide roller 53 makes contact with the slanted portion 521 of the slanted bearing 52 that, as a result of the intermediate transfer belt 31 meandering, moves in the axial direction Dx of the tension roller 36.

Furthermore, when the slanted bearing 52 moves outward (rightward in FIG. 4) in the axial direction Dx, the main body guide roller 53 rolls on the slanted face of the slanted portion 521, and one end (the right end in FIG. 4) of the tension roller 36 in the axial direction Dx moves downward. That is, the main body guide roller 53 moves the slanted bearing 52, along with the one end of the tension roller 36 in the axial direction Dx, in the direction perpendicular to the axial direction Dx.

With this construction, the contact between the main body guide and the slanted bearing 52 is turned into rolling friction. Rolling friction is far smaller than sliding friction and thus helps achieve a reduced friction load. That is, even with a construction where the tension roller 36 can incline steeply, it is not necessary to increase the device size in the axial direction Dx of the tension roller 36, and this helps suppress an increase in the size of the image forming apparatus 1. Furthermore, by reducing the friction load, it is possible to reduce wear on the main body guide and the slanted bearing 52. Thus, with a construction that suppresses an increase in the size of the image forming apparatus 1, it is possible to correct meandering of the intermediate transfer belt 31 with enhanced performance.

The correcting mechanism 50 includes a belt guide 51, a slanted bearing 52, a main body guide roller 53, and an urging member 54 constructed as described above. At the tension roller 36, where tension is given to the intermediate transfer belt 31, the intermediate transfer belt 31 easily meanders. Thus, by providing the correcting mechanism 50 as an alignment adjusting mechanism for the tension roller 36, it is possible to correct meandering of the intermediate transfer belt 31 with enhanced performance.

The slanted bearing 52 has the slanted portion 521 and the parallel portion 522 that are formed along the axial direction of the tension roller 36 so as to be continuous with each other. With this construction, when the intermediate transfer belt 31 rotates normally without meandering, the main body guide roller 53 makes contact with the parallel portion 522. Thus, the tension roller 36 can be rotated suitably in a predetermined position. When the intermediate transfer belt 31 is meandering, one end of the tension roller 36 in the axial direction Dx can be moved in the direction perpendicular to the axial direction Dx.

The description given above of an embodiment of the present disclosure is in no way meant to limit the scope of the present disclosure; the present disclosure can be implemented with any modifications made without departing from the spirit of the present disclosure.

For example, while in the embodiment described above the image forming apparatus 1 is assumed to be a color-printing image forming apparatus of what is called a tandem type, this is not meant as any limitation to that and similar types. The image forming apparatus may be a color-printing image forming apparatus of any type other than a tandem type so long as it has an intermediate transfer belt.

What is claimed is:

1. An image forming apparatus comprising:

a plurality of image carrying members;

an endless intermediate transfer belt to which toner images formed on the plurality of image carrying members respectively are transferred by being sequentially superposed on each other;

a plurality of rollers around which the intermediate transfer belt is rotatably stretched; and a correcting mechanism which corrects meandering of the intermediate transfer belt with respect to the rollers, wherein the correction mechanism includes a slanted bearing having a slanted portion slanted with respect to an axial direction of the roller, the slanted bearing rotatably supporting a shaft portion of one roller among the plurality of rollers, the slanted bearing being movable in the axial direction of the said one roller, and a main body guide which makes contact with the slanted portion of the slanted bearing when the slanted bearing, as a result of the intermediate transfer belt meandering, moves in the axial direction of the said one roller, the main body guide then moving the slanted bearing along with one end of the said one roller in the axial direction in a direction perpendicular to the axial direction, and the main body guide is a rotary member which rotates, while in contact with the slanted bearing, about an axis extending in the direction perpendicular to the axial direction of the roller.

2. The image forming apparatus according to claim 1, wherein the correction mechanism includes a belt guide which is arranged at each end of the roller in the axial direction inward of the slanted bearing in the axial direction and which makes contact with a side edge of the intermediate transfer belt, and an urging member which urges the slanted bearing toward the main body guide so as to keep the slanted bearing in contact with the main body guide.

3. The image forming apparatus according to claim 1, wherein the slanted portion of the slanted bearing is so slanted as to be, while extending from outward to inward in the axial direction of the roller, increasing outward from a central part of the roller in a radial direction, and the slanted bearing has a parallel portion which is formed outward, in the axial direction of the roller, of the slanted portion so as to be continuous therewith and which extends parallel to the axial direction of the roller.

* * * * *